US008800966B2

(12) United States Patent
Cordes

(10) Patent No.: US 8,800,966 B2
(45) Date of Patent: Aug. 12, 2014

(54) DRAIN PLUG

(71) Applicant: Robert Cordes, Liberty Lake, WA (US)

(72) Inventor: Robert Cordes, Liberty Lake, WA (US)

(73) Assignee: Drainzit, LLC, Liberty Lake, WA (US)

( * ) Notice: Subject to any disclaimer, the term of this patent is extended or adjusted under 35 U.S.C. 154(b) by 113 days.

(21) Appl. No.: 13/658,944

(22) Filed: Oct. 24, 2012

(65) Prior Publication Data

US 2014/0109986 A1 Apr. 24, 2014

(51) Int. Cl.
*F16K 31/00* (2006.01)

(52) U.S. Cl.
USPC ..... 251/344; 251/346; 251/347; 251/348; 251/322; 251/323

(58) Field of Classification Search
USPC ..... 251/100, 296, 322, 323, 340, 343, 344, 251/346, 347, 348
See application file for complete search history.

(56) References Cited

U.S. PATENT DOCUMENTS

| | | | | | |
|---|---|---|---|---|---|
| 1,052,556 | A | * | 2/1913 | Bahan | 141/55 |
| 1,150,641 | A | * | 8/1915 | Smith | 251/253 |
| 1,439,062 | A | * | 12/1922 | Brooks | 251/149.8 |
| 1,813,581 | A | * | 7/1931 | Rodrigues | 251/155 |
| 2,502,301 | A | * | 3/1950 | Alderfer | 137/223 |
| 2,506,722 | A | * | 5/1950 | Kuehn et al. | 251/322 |
| 2,552,445 | A | * | 5/1951 | Nielsen | 239/456 |
| 2,591,514 | A | * | 4/1952 | Courtot | 251/297 |
| 2,690,895 | A | * | 10/1954 | Barcus | 251/297 |
| 2,692,112 | A | * | 10/1954 | Szitar, Jr. | 251/66 |
| 2,855,946 | A | | 10/1958 | Mackal | |
| 3,387,621 | A | | 6/1968 | Schaff | |
| 4,745,894 | A | | 5/1988 | Laipply et al. | |
| 4,856,756 | A | * | 8/1989 | Combs | 251/297 |
| 4,880,029 | A | | 11/1989 | Koller | |
| 4,951,723 | A | | 8/1990 | Hoeptner, III | |
| 5,411,115 | A | | 5/1995 | Shropshire | |
| 5,433,410 | A | | 7/1995 | Foltz | |
| 5,451,031 | A | | 9/1995 | Purvis et al. | |
| 5,478,049 | A | | 12/1995 | Lescoe | |
| 5,749,561 | A | * | 5/1998 | Worthington | 251/229 |
| 5,778,928 | A | | 7/1998 | Boland et al. | |
| 6,145,623 | A | | 11/2000 | Cordes | |
| 6,152,199 | A | | 11/2000 | Nusbaumer et al. | |
| 6,206,344 | B1 | | 3/2001 | Takahara | |
| 8,210,501 | B2 | * | 7/2012 | Lee | 251/354 |

* cited by examiner

*Primary Examiner* — John Rivell
*Assistant Examiner* — Matthew W Jellett
(74) *Attorney, Agent, or Firm* — Paine Hamblen, LLP

(57) ABSTRACT

A drain plug for selectively draining a source of fluid is described, and which includes first, second and third portions which provide coaxially aligned fluid passageways which extend therethrough, and wherein the second portion is moveable relative to the first and third portions between a first position which substantially occludes, and prevents the passage of fluid through the coaxial aligned fluid passageways, and a second position where fluid is allowed to pass therethrough and may be collected for disposal as required.

11 Claims, 7 Drawing Sheets

DRAIN PLUG

TECHNICAL FIELD

The present invention relates to a drain plug, and more specifically to a drain plug that allows for the transfer or movement of fluid through an inner passageway of the device. The present invention replaces a standard threaded oil drain plug on an engine's crank case, for example, thereby selectively permitting the draining of oil from the engine and directing the used oil into a detachable flexible fluid conduit where the oil may be then transmitted to a waste fluid receptacle for proper disposal.

BACKGROUND OF THE INVENTION

Devices such as pressure washer, air compressors, electrical generators, and garden tools such as lawnmowers and the like, and which are used in both commercial and residential applications, typically have a fluid reservoir such as a crank case, transmission housing, gear box or other enclosure which contains a quantity of fluid such as lubricating oil, transmission fluid or the like. Routine maintenance of these and other similar devices necessarily requires that a quantity of fluid in these fluid reservoirs be periodically drained and then be replaced from time-to-time. The draining and replacing of this fluid, however, can become a messy and inconvenient task due to the location of such fluid reservoirs on these devices. These prior art powered devices, of various designs, typically include a small displacement internal combustion engine having a quantity of oil residing in the crank case thereof. For purposes of this disclosure, such an engine is typically referred to as a "small engine" although other devices with fluid reservoirs may comprise two cycle engines, electrical motors or other engine configurations.

Typically, a manufacturer of one of these prior art powered devices will purchase a small engine, separate from a functional component such as a pump, to be driven by the small engine. The manufacturer will then mount the small engine, and the functional component together, on a chassis, as part of the final assembly. In order to provide a sturdy chassis, as well as keep the manufacturing costs as low as possible, the chassis on which the small engine and the functional component are mounted is frequently a solid metal platform. Although the chassis can also compromise an open framework such as might be seen on a common roto-tiller, lawnmower or the like.

Typically, in powered devices of this type, the fluid reservoir for such devices which may comprise a crank case, transmission gear box or other enclosure, includes a drain outlet which is located, usually, in a very elevationally low position relative to the fluid reservoir so as to ensure that the maximum amount of fluid can be removed from the fluid reservoir when draining same. To remove a portion, or all of the quantity of a fluid from a fluid reservoir, for example, the drain plug is threadably removed from the drain passageway or outlet, of the fluid reservoir, and then a quantity of the fluid flows through the drain outlet. When the draining process is complete, the standard threaded drain plug is threadably advanced back into the drain outlet of the fluid reservoir, and a source of new fluid is delivered back into the reservoir through another conduit, or fill passageway.

In automotive engines, the drain outlet is normally located at the bottom of the engine. This permits the oil to drain from the lowest possible location when the standard, threaded drain plug is removed. However, in small engine applications, and the like, and since a small engine is typically mounted on a solid metal platform or chassis as discussed, above, a bottom drain outlet is usually impractical. Such a bottom drain outlet configuration would normally require that the assembler of a resulting finished product to provide for an opening in the chassis in order to facilitate access to the drain outlet and the standard threaded drain plug. Additionally, and in applications for powered devices such as a roto-tiller, for example, a bottom drain outlet would be difficult to access due to the presence of the tines of the roto-tiller which are usually located beneath the engine. Consequently, small engine manufacturers and others, have taken to orienting or otherwise providing a drain outlet on the side of the engine, and at a location which is as low as possible so as to permit the maximum amount of fluid, such as lubricating oil, to be drained from the engine, and without requiring the manufacturer to accommodate a bottom drain outlet. FIG. 1, as provided herewith, shows an exemplary device which uses a small engine of the type described, above. The device, as depicted, is a pressure washer which pumps water at high pressure through a hose for purposes of washing sidewalks, and the like. The device includes a pump which is driven by a small engine. The pump and engine are integrally mounted on a platform which is depicted in the drawing as a solid platform. Located towards the bottom of the engine is a fluid reservoir which is enclosed within the engine crank case. A drain outlet is located at the lower side of the fluid reservoir or crank case. It should be immediately apparent that when a standard threaded drain plug is removed from the drain outlet, the lubricating oil will immediately pour out across the chassis. Beyond the obvious problems this presents in collecting the messy fluid, it also requires a significant amount of clean up time to remove any remaining fluid from the device. It also results in unnecessary human exposure to the fluid. Further, this arrangement also presents an environmental hazard.

Some solutions to this problem have been offered by the manufacturers of such prior art devices. However, they do not practically resolve the problems. For example, tipping the powered device on which the engine is mounted in the direction of the drain hole while draining the crank case may help direct fluid run off to one edge of the chassis. However, it is difficult for one person to perform this act, alone, and the results are less than ideal. Further, because of the proximity of the drain outlet to the chassis, the positioning of a container near or under the drain outlet is difficult. Unless the device is tipped on its side, it is of little, or no value in collecting the draining lubricating fluid.

Likewise, providing a hole in the chassis near the drain outlet does not seem to help much in view of the fact that the fluid tends to course or drain out of the drain hole quite quickly, and often time by-passes the hole on the chassis when the standard threaded drain plug is initially removed. Moreover, providing such a hole or aperture in the chassis seems of little help especially for a device having a significant, under platform, component such as tines of a roto-tiller or the blade of a lawnmower, for example. Additionally, positioning the engine closer to the edge of the chassis typically is not an option inasmuch as it would result in an uneven weight distribution of the components on the chassis, and may not even be possible depending upon the configuration of the device to which the engine is to be coupled.

Thus, what is needed is something which permits a source of fluid, such as a lubricating oil, to be easily drained from an inconvenient drain outlet which is made integral with a fluid reservoir, such as a platform mounted side drain and crank case arrangement, as illustrated, and which further allows the fluid to be easily collected into a fluid receptacle while producing minimal spillage of the fluid on the implement or in the immediate environment.

The Office's attention is directed to my previous patented invention entitled "Oil Drain Line" [U.S. Pat. No. 6,145,623], the teachings of which are incorporated by reference herein. While my previous invention addresses many of the shortcomings identified in the prior art practices, my previous device still requires that a segment of flexible tubing be left coupled to the fluid reservoir at all times. Further, the Office's attention is directed to my U.S. application Ser. No. 11/156,209 and which was filed on Jun. 17, 2005, now abandoned.

In comparison to the teachings found in my prior art patent, the present invention provides a substantially more secure means of selectively permitting the transfer of fluid from an associated powered apparatus which includes a fluid reservoir. Further, the present invention also does not require that a flexible tube be coupled to the device at all times. The present invention, therefore, is a significant improvement over my prior invention as will be understood from the following description and accompanying drawings.

SUMMARY OF THE INVENTION

A first aspect of the present invention relates to a drain plug for selectively draining a source of fluid which includes a first portion having a main body which releasably mates with a reservoir enclosing a source of fluid to be drained, and which defines a first fluid passageway, and which further defines an annular shaped passageway; and a second portion which telescopes at least partially within the annular shaped passageway defined by the main body of the first portion, and which further defines a second fluid passageway which is coaxially aligned with the first fluid passageway; and wherein the second portion is slideably moveable from a first position which inhibits the source of fluid from passing out through the coaxially aligned first, and second fluid passageways, and a second position, where the second portion permits the source of fluid to pass through the coaxially aligned first, and second fluid passageways.

Another aspect of the present invention relates to a drain plug which includes a first portion which releasably mates with a reservoir enclosing a source of fluid to be drained, and which defines a first fluid passageway; a second portion which telescopes at least partially within the first fluid passageway, and which is slideably moveable within the first fluid passageway, and wherein the second portion defines a second fluid passageway which is coaxially aligned with the first fluid passageway; and a third portion which is telescopingly received within the second fluid passageway, and which is affixed to the first portion, and wherein the third portion defines a third fluid passageway which is coaxially aligned with the first and second fluid passageways, and wherein the second portion is slideably moveable from a first position which inhibits the source of fluid from passing out through the coaxially aligned first, second, and third fluid passageways, and a second position where the second portion permits the source of fluid to pass through the coaxially aligned first, second and third fluid passageways.

Still another aspect of the present invention relates to a drain plug which includes a first portion of the drain plug having a main body with a first end which releasably mates with a reservoir enclosing a source of fluid to be drained, and an opposite, second end, and wherein a first fluid passageway extends from the first to the second end; a second portion of the drain plug having a main body with a first end which telescopes at least partially within the first fluid passageway which is defined by the first portion, and which is slideably movable within the first fluid passageway, and wherein the second portion further has a second end which extends coaxially, outwardly relative to the second end of the first portion of the drain plug, and wherein a second fluid passageway extends between the first and second ends of the second portion, and which is further coaxially aligned with the first fluid passageway; and a third portion of the drain plug which has a main body that has a first end which is telescopingly received, at least in part, within the coaxially aligned first and second fluid passageways as defined by the first and second drain plug portions, and wherein the first end of the third portion is releasably affixed to the first portion of the drain plug, and wherein the main body of the third portion has an opposite, second end, and wherein a third fluid passageway extends between the first and second ends of the third portion, and wherein a fluid discharge orifice is formed at a location adjacent to the second end of the main body of the third portion, and wherein the second portion of the drain plug is slideably moveable from a first position, and where the second portion is located in covering, occluding relationship relative to the fluid discharge orifice, and which further inhibits the source of the fluid from passing out through the coaxially aligned first, second, and third fluid passageways, and a second position, where the second portion is moved to a non-occluding position relative to the fluid discharge orifice, and which further permits the source of the fluid to pass through the coaxially aligned first, second, and third fluid passageways, and be released through the fluid discharge orifice.

These and other aspects of the present invention will be discussed in greater detail hereinafter.

BRIEF DESCRIPTION OF THE DRAWING

Preferred embodiments of the invention are described, below, with reference to the following accompanying drawings.

DETAILED DESCRIPTION OF THE PREFERRED EMBODIMENTS

This disclosure of the present invention is submitted in furtherance of the constitutional purposes of the U.S. Patent laws "to promote the progress of science and useful arts." (Article I, Section 8).

First Form

Figure 1:
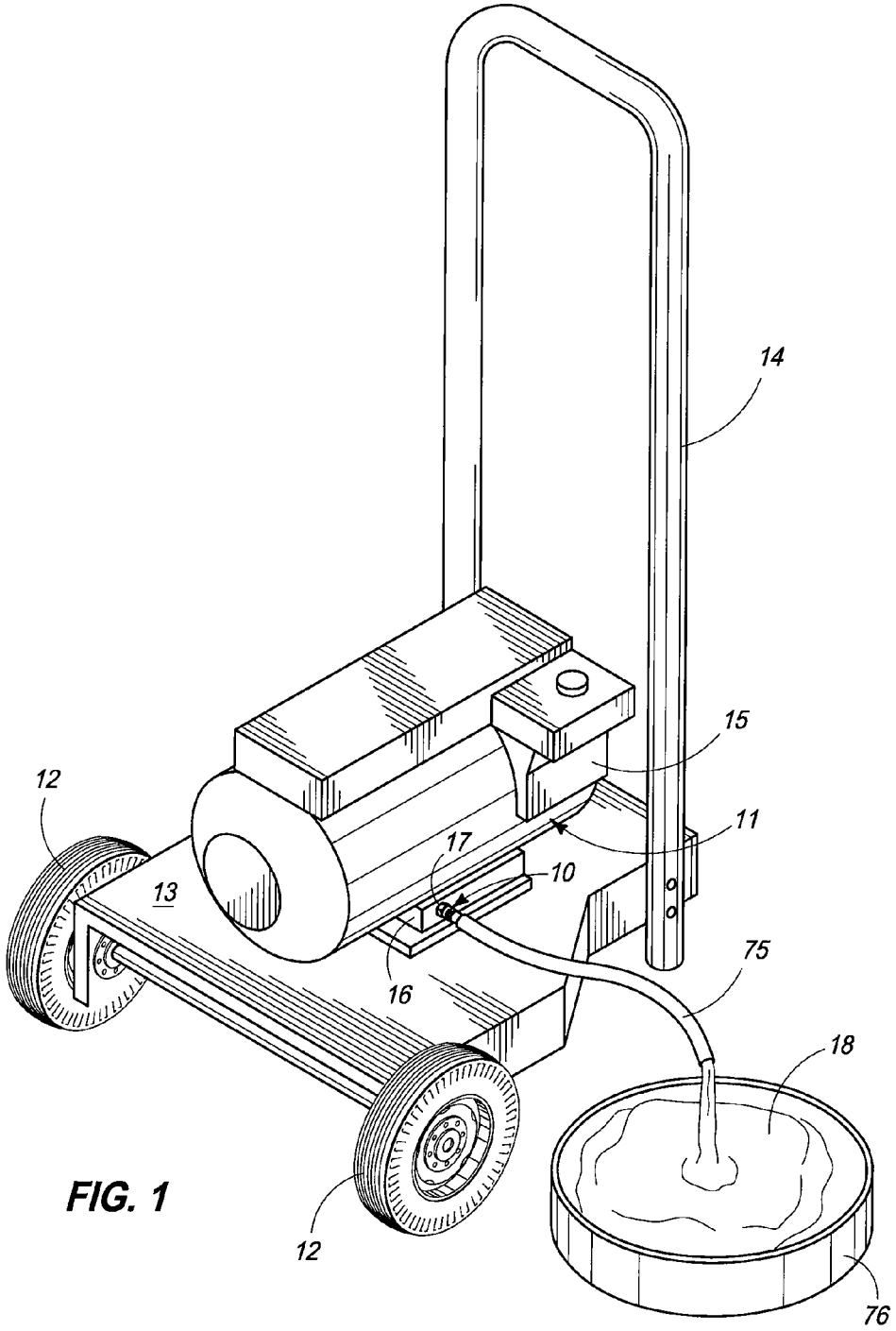
FIG. 1 is a perspective, environmental view illustrating a first form of the present invention, and which shows the invention in a typical operational environment.

Referring now to FIG. 1, it will be seen that the present invention is generally indicated by the number 10, and is depicted herein in a typical operational environment where it is affixed to a powered pressure washer or other similar powered device 11 which utilizes a source of fluid (such as a lubricating oil) that periodically needs to be drained from the device. In this regard the powered pressure washer 11 includes earth engaging wheels 12, and a chassis 13, which is mounted on the earth engaging wheels, and which allows it to be moved from place-to-place during operation. Still further, a handle 14 is mounted on the chassis, and which allows an operator, not shown, to easily move the powered pressure washer 11 from one location to another. Mounted on the chassis 13 is an internal combustion motor 15 which has a crank case 16 which defines a reservoir for enclosing a source of fluid 18 to be drained. The crank case 16 has a threaded opening 17 through which the source of fluid 18 which was previously confined in the crank case or reservoir 16 may be drained.

Figure 6:
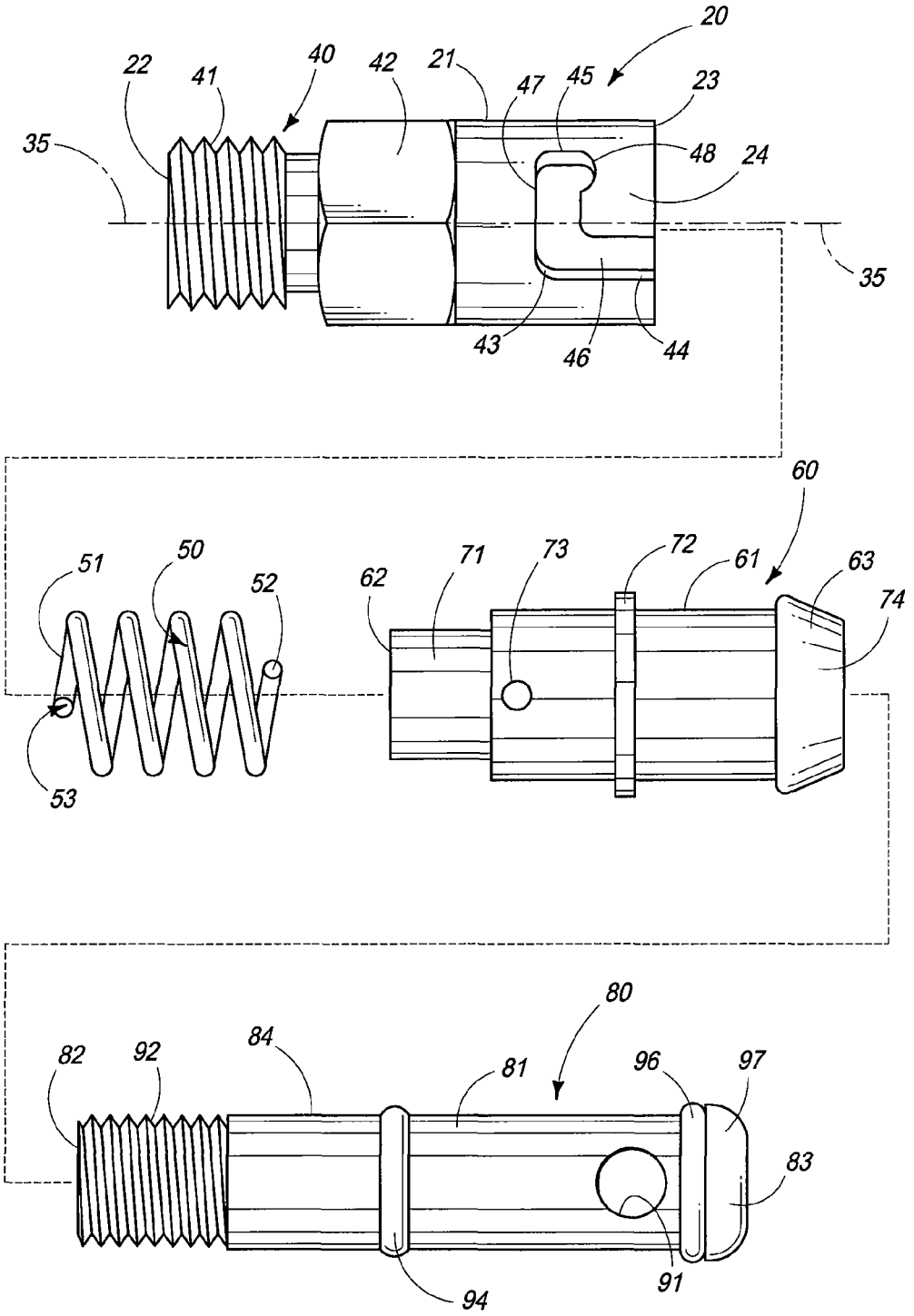
FIG. 6 is an exploded, side elevation view of the first form of the present invention.
Figure 7:
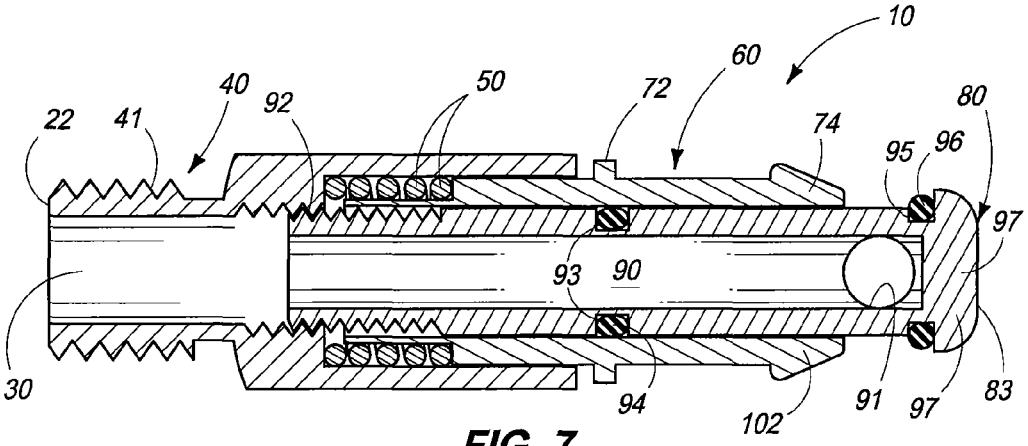
FIG. 7 is a longitudinal, vertical, cross sectional view of the first form of the present invention, and which is illustrated in an open position.
Figure 8:
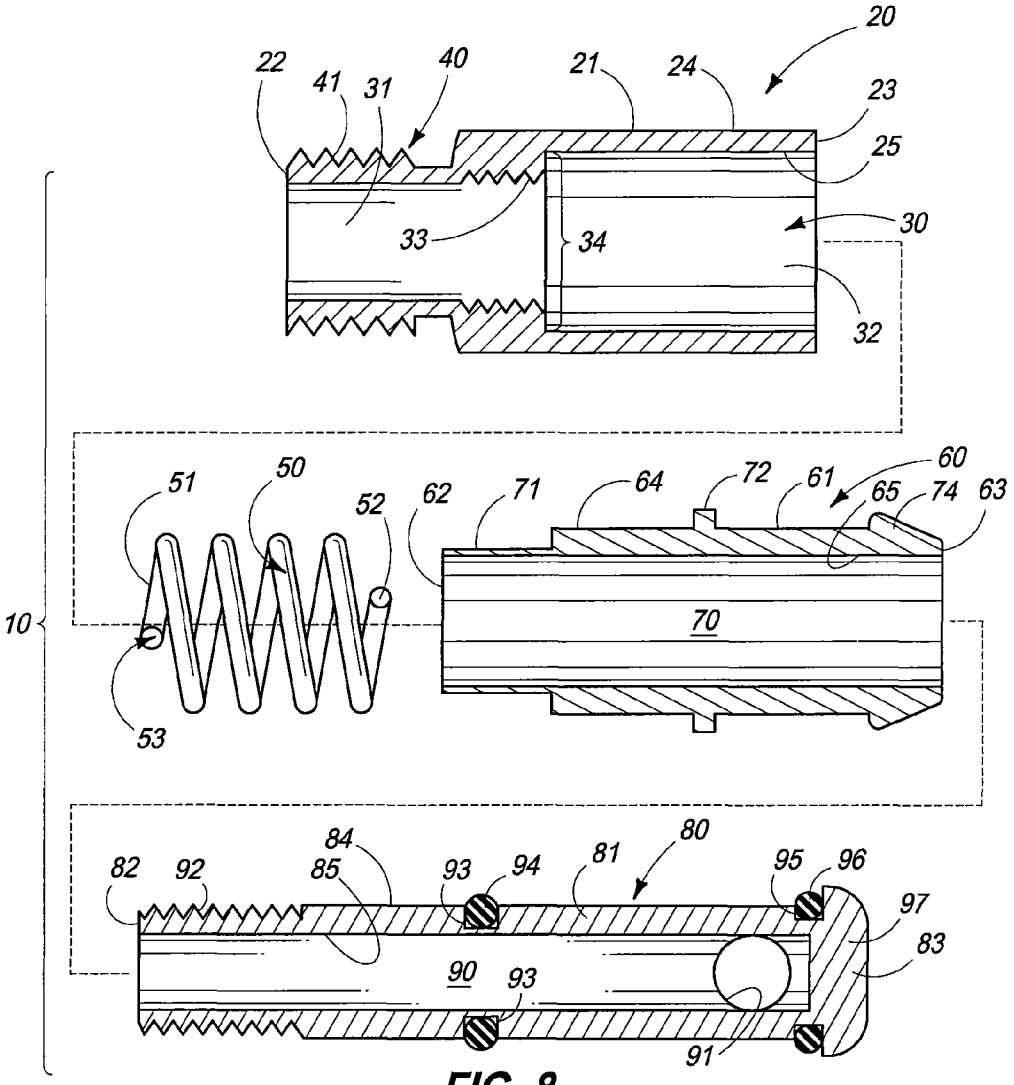
FIG. 8 is an exploded, longitudinal, vertical sectional view of the first form of the present invention.

Referring now to FIGS. 6 and 7, the drain plug 10 includes a first portion which is generally indicated by the numeral 20. The first portion 20 has a main body 21, which has an opposite first, and second end 22 and 23, respectively. The main body is further defined by an outside facing surface 24, and opposite, inside facing surface 25, (FIG. 8). The inside facing surface 25 defines a first fluid passageway 30 which extends between the first and second ends 22 and 23, respectively. The first fluid passageway includes a first section 31 which has a first, predetermined diametral dimension, and a second section 32 which has a second diametral dimension which is greater than that of the first section. Additionally, it will be seen from the drawings that the first section 31 of the first fluid passageway 20 has a screw threaded region 33 formed therein. Additionally, it will be noted from the drawings that a spring seat 34 is defined between the first and second sections 31 and 32 respectively of the first fluid passageway 30. As seen most clearly by reference to FIG. 6, the first portion 20, and more specifically the first end 22, thereof, has formed in the outside facing surface 24 a reduced outside diametral portion 40. As depicted in that drawing, the reduced outside diametral portion 40 has screw threads 41 formed therein. The screw threads are operable to matingly, screwthreadably cooperate with the opening 17 which is formed in the crank case 16 of the internal combustion motor 15. Additionally, and formed into the outside facing surface 24, is a tool engagement region 42 (FIG. 6) which provides a means by which a prior art hand tool may be employed, and which is useful for creating an advancing, or withdrawing longitudinal, rotatable movement of the main body 21 so as to threadably advance or withdraw the main body 21 relative to the crank case 16. As seen further in FIG. 6, the main body 21 includes, or has formed therein, a guidance pin passageway 43, which is formed in the second end 23 thereof. The guidance pin passageway has a first end 44, and an opposite, second end 45. Additionally, the guidance pin passageway has a first leg 46 which is oriented substantially along the longitudinal axis 35 of the main body 21, and a second leg or portion 47 which is disposed substantially transversely relative to the longitudinal axis 35. Additionally, and as seen in the drawings, the guidance pin passageway 43 has a guidance pin seat 48 which is located at the second end 45, thereof.

As best understood by references to FIG. 7 and FIG. 8, the drain plug 10 of the present invention includes a coil spring 50 which is received within the first fluid passageway 30, and which is positioned in rested relation on the spring seat 34, and within the second section 32 of the first fluid passageway 30. The coil spring has a first end 51 which rests upon the spring seat 34, and an opposite, second end 52. Still further, the coil spring 50 defines an internal passageway 53 extending, therethrough, and which is coaxially aligned with the first fluid passageway 30.

The present invention 10 further includes a second portion 60 which telescopes, at least partially, within the first fluid passageway 30, and which further is longitudinally, slideably moveable, and partially coaxially rotatable within the first fluid passageway 30. The second portion 60 defines a second fluid passageway, as will be discussed, below, and which is substantially coaxially aligned with the first fluid passageway 30. In this regard, the second portion 60 has a main body 61 which has a first end 62, which is telescopingly received within the first fluid passageway 30. Still further the main body 61, has an opposite second end 63, and which extends longitudinally, outwardly relative to the first end 22, of the first portion 20. As will be recognized, the main body has an outside facing surface 64, and an opposite, inside facing surface 65 which defines the second fluid passageway 70, and which is substantially, coaxially aligned relative to the first fluid passageway 30. As seen in FIG. 8, the second portion 60 has a reduced diametral outside portion 71. This reduced diametral outside portion 71, and which is located at the first end 62 of the main body 61, is operable to be telescopingly received within the internal passageway 53 as defined by the coil spring 50. Therefore, it will be understood from the drawings that the coil spring 50 is positioned between the spring seat 34, and further cooperates or otherwise matingly engages the first end 62 of the second portion 60. As further seen in FIG. 8, it will be understood that the main body 61 further includes a circumscribing flange member 72 which is located between the first and second ends 62 and 63, thereof. This circumscribing flange member 72 operates in the present device 10 to provide a movement limiting function for the second portion 60 which is both slideably, and partially rotatably moveable within the first fluid passageway 30. Additionally, and mounted between the circumscribing flange member 72, and the first end 62 thereof, there is a guidance pin 73 (FIGS. 4 and 6) which extends substantially radially, outwardly, relative to the main body 61. The guidance pin 73 is dimensioned so as to be received, and be moveable along the guidance pin passageway 43 which is formed in the first portion 20, and in a manner which will be discussed in greater detail, hereinafter. Additionally, and formed at the second end 63, of the main body 61, is a hose barb 74. The hose barb 74 is operable to releasably couple with a resilient flexible fluid conduit 75, as best illustrated by reference to FIG. 1 and FIG. 2, respectively. The flexible conduit is operable to provide a means for directing or otherwise channeling the source of fluid 18 which is enclosed within the reservoir, as represented by the crank case 16, so that it may be deposited within a waste receptacle that is generally indicated by the numeral 76.

The drain plug 10 of the present invention includes a third portion 80 which is telescopingly received within the second fluid passageway 70, and which is further affixed to the first portion 20 in the manner as will be described, hereinafter. The third portion 80, has a main body 81, which has a first end 82, which is releasably affixed to the first portion 20, and which further has an opposite, second end 83. The main body 81 has an outside facing surface 84, and an opposite, inside facing surface 85 which defines a third fluid passageway 90 which is substantially coaxially aligned relative to the first and second fluid passageways 30 and 70, respectively. The third fluid passageway 90 extends from the first end 82, and in the direction of the second end 83. The third fluid passageway 90 terminates at a fluid discharge orifice 91 which is located in spaced relation relative to the second end 83. As will be seen in the drawings (FIG. 6), the main body 81, in the vicinity of the first end 82, defines a threaded region 92 which is formed in the outside facing surface 84. This threaded region 92 is operable to threadably, and matingly cooperate with the screw threaded region 33 which forms a portion of the first section 31, of the first fluid passageway 30. Still further, and as seen in FIGS. 6, and 8, respectively, the third portion 80 has formed in the outside facing surface 84 a first seal seat 93 which circumscribes the outside facing surface 84. A first sealing member 94, in the form of a resilient O ring, is received in the first seal seat 93, and is operable to sealably engage the second portion 60, and more specifically the inside facing surface 65 which forms the second fluid passageway 70. This is best illustrated by reference to FIG. 7. Still further, a second seal seat 95 is formed adjacent to the second end 83 of the main body 81. Again, the second seal seat receives a second sealing member 96 in the form of a resilient O ring which is received within the second seal seat. Still further, and as seen in FIG. 8, for example, the main body 81 has a flange member 97 which is positioned at the second end 83, and the second sealing member 96 is juxtaposed relative to the flange member 97. As illustrated in the drawings, the main body 81 further defines a fluid discharge orifice 91 which is located in spaced relation relative to the second end 83 of the main body 81. The fluid discharge orifice 91, when non-occluded, allows for the passage or release of the source of fluid 18 from the reservoir, such as the crank case 16, to flow through the first, second, and third coaxially aligned fluid passageways 30, 70, and 90, respectively, so that it may be properly disposed of.

Figure 2:
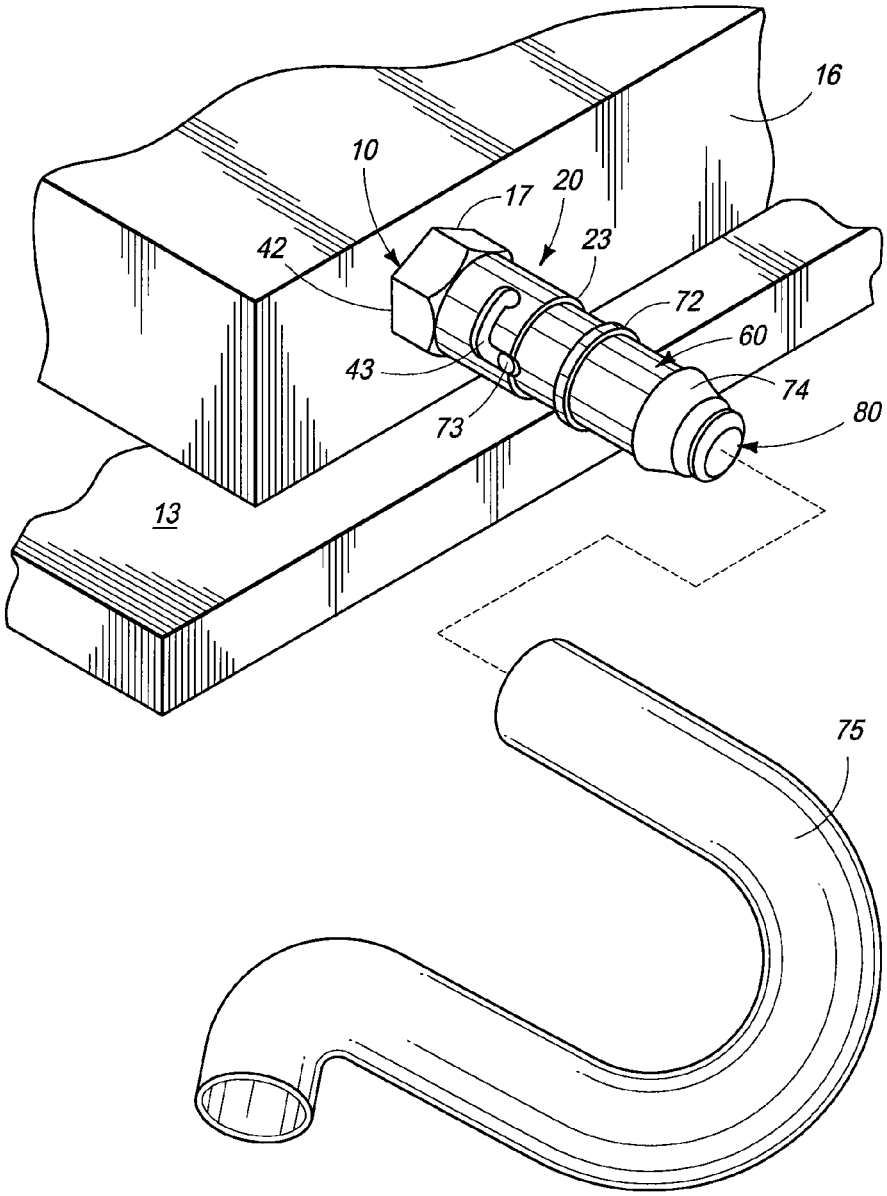
FIG. 2 is a partial, perspective, environmental view illustrating the first form of the present invention in a closed position.
Figure 3:
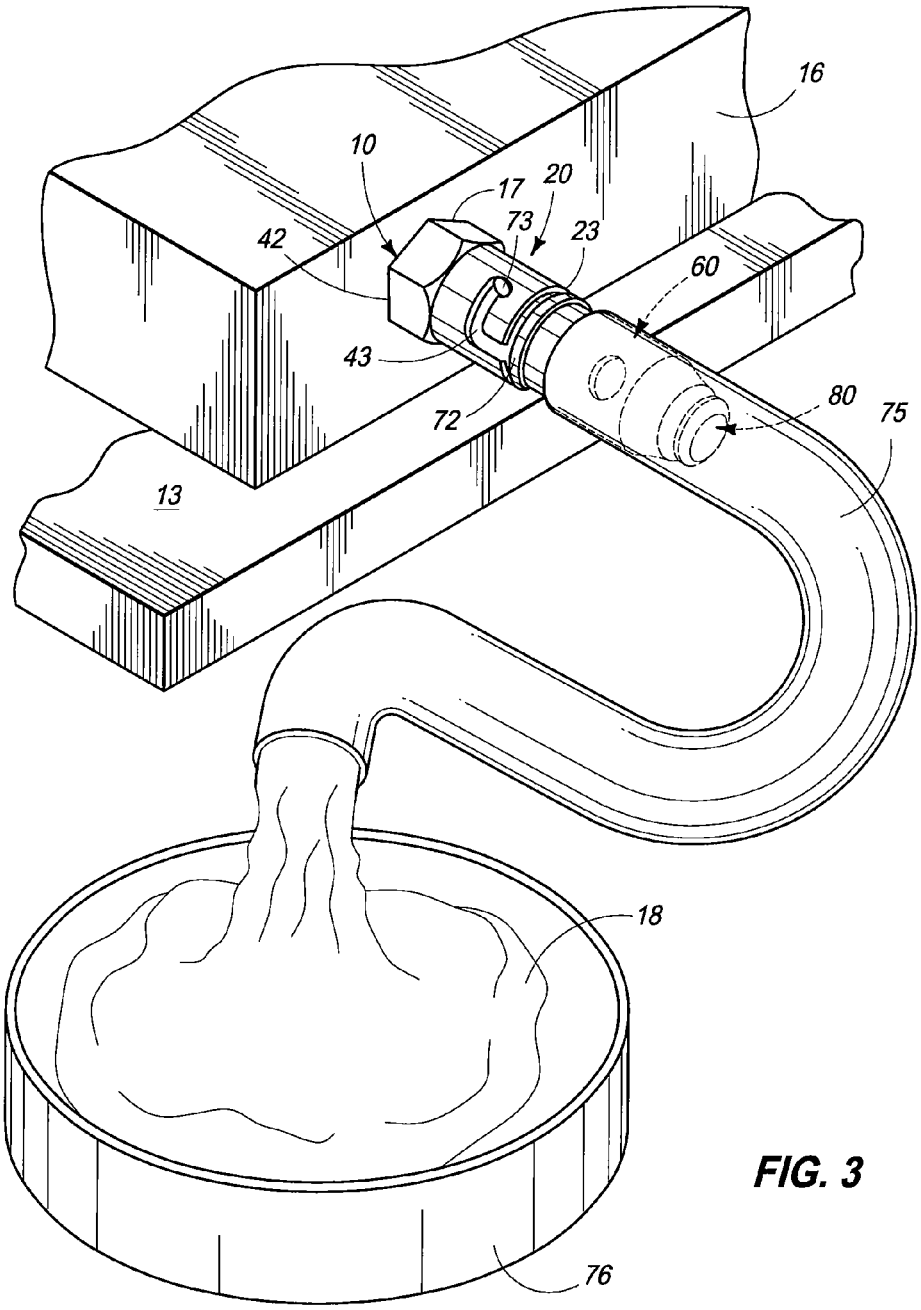
FIG. 3 is a partial, perspective, environmental view illustrating the first form of the present invention in an open position.
Figure 4:
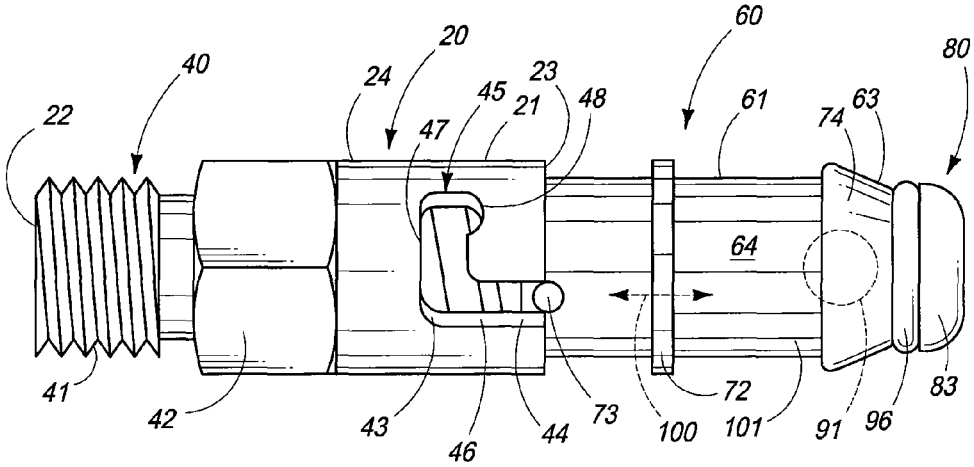
FIG. 4 is a side elevation view of the first form of the present invention and which is illustrated in a closed position.
Figure 5:
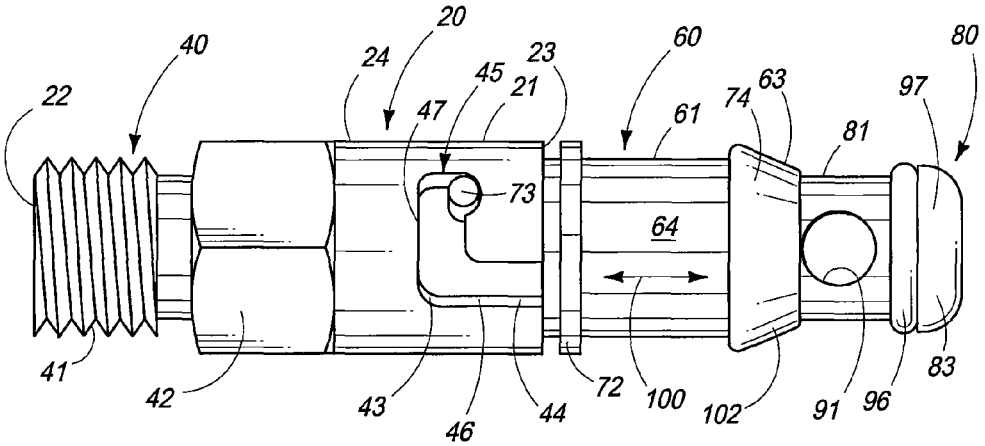
FIG. 5 is a side elevation view of the first form of the present invention and which is illustrated in an open position.

Referring now to FIGS. 4 and 5 respectively, it will be seen that the second portion 60 of the drain plug 10 is slideably moveable along a path of travel 100, from a first position 101, where the second portion 60 is located in covering, occluding relation relative to the fluid discharge orifice 91, as seen in FIG. 4, and which inhibits the source of the fluid 18 which is contained within the crank case, or reservoir 16 from passing out through the coaxial aligned first, second, and third fluid passageways 30, 70, and 90, respectively. Still further, the second portion 60 is also moveable to a second position 102, as seen in FIG. 5, and which further permits the source of the fluid 18 to pass through the coaxially aligned first, second, and third passageways 30, 70, and 90, respectively, and be released through the fluid discharge orifice 91. It will be understood from studying the drawings, that when located in the first position 101, the guidance pin 73 is located at the first end 44 of the guidance pin passageway 43. In the first position 101, as earlier described, it will be seen that the second end 63, of the second portion 60, is moved into juxtaposed fluid sealing engagement thereagainst the second sealing member 96 which is mounted on the second end 83 of the third portion 80. Again, in the first position 101, the second portion 60 prohibits the discharge or release of any fluid 18 through the fluid discharge orifice 91. However, when a user grasps the main body 61 of the second portion 60 and urges it rearwardly, and against the biasing force exerted by the coil spring 50, the guidance pin 73 travels or moves along the first leg 46 of the guidance pin passage 43, and thereafter, by twisting or rotating the second portion 60 the guidance pin can be urged to move along the second leg 47, and then come to rest within the guidance pin seat 48 as seen in FIG. 5. In the guidance pin seat 48, the second portion 60 has been moved to the second position 102, and which leaves the fluid discharge orifice 91 in a non-occluded position. In the non-occluded second position 102, the fluid 18 which is contained within the reservoir as represented by the crank case 16 can be released by way of the fluid discharge orifice 91. As depicted in FIG. 2, a length of flexible conduit 75 may be placed over the hose barb 74, prior to the movement of the second portion 60, and which is effective in releasing the source of fluid 18 from the reservoir. This permits the fluid 18 to pass out through the fluid discharge orifice 91 and then be directed to a waste receptacle 76 as depicted in FIG. 3. Once the fluid 18 from the crank case 16 is removed, a user would merely rotate the second portion 60 so as to direct the guidance pin 43 back along the second leg 47, and down the first leg 46, to the first position 101. As seen in FIG. 4, in the first position 101, the second portion 60 is oriented so as to occlude the fluid discharge orifice 91 to prevent the release of more fluid from the reservoir 16.

Second Form

Figure 9:
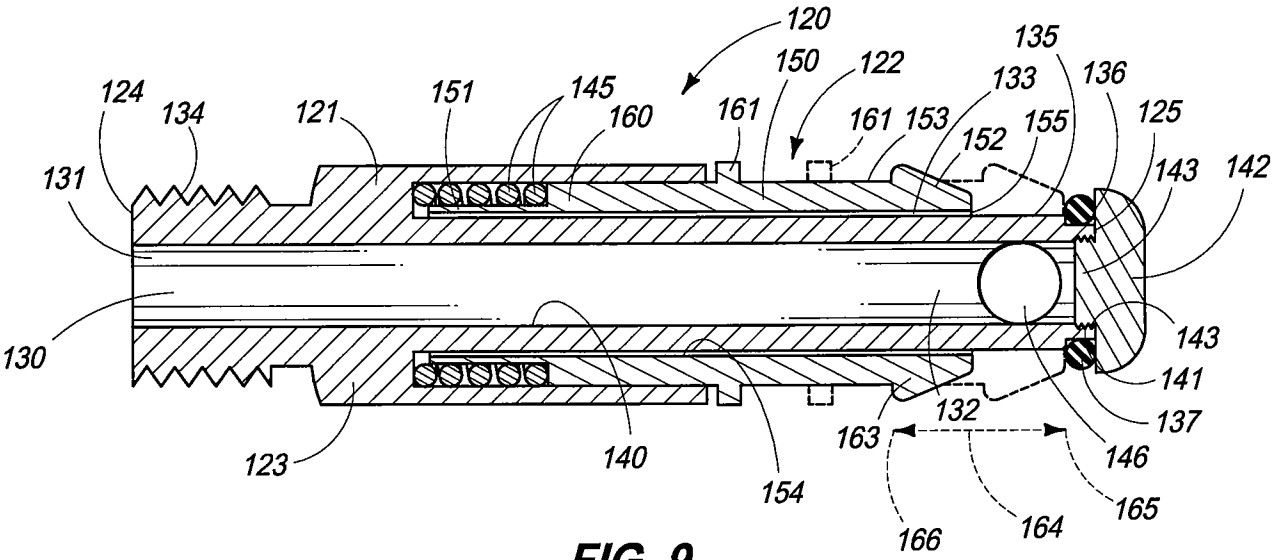
FIG. 9 is a longitudinal, vertical sectional view taken through a second form of the present invention.

The second form of the invention is generally indicated by the numeral 120, and is best seen in the longitudinal, vertical, sectional view as seen in FIG. 9. In the second form of the invention, the three piece construction as seen in FIGS. 1-8, respectively, has now been reduced to a two piece construction as will be described below. In this regard, the second form of the invention 120 includes a first portion 121 and which is operable to threadably mate with the threaded opening 17 as provided in the reservoir 16 as seen in FIG. 1. Still further, the second form of the invention 120 includes a second portion 122, and which is telescopingly received, at least in part, with the first portion 121. In particular, the first portion 121 has a main body 123 which has a first end 124 which threadably mates with the reservoir 16, and an opposite second end 125. As seen in FIG. 9, the main body 123 defines a first fluid passageway 130 which extends from the first end 124, to the second end 125. The first fluid passageway similarly has a first end 131 and a second end 132. Additionally, the main body 123 of the first portion 121 defines an annular shaped passageway 133 which extends from the second end 125 and in the direction of the first end 124. As will be recognized from the drawing, the annular shaped passageway has diametral dimension which is greater than the diametral dimension of the first fluid passageway as measured at the first end 124 of the main body 123. The main body 123, and more specifically the first end thereof 124 has a reduced outside diametral dimension, and has a threaded portion 134 which is operable to screwthreadably mate with the reservoir 16. Still further, the main body 123 of the first portion has an outside facing surface 135. Further, formed in the outside surface 135, and in the vicinity of the second end 125 is a seal seat 136. The seal seat 136 is operable to receive an O-ring, resilient seal 137 which is similar to what was described in the first form of the invention. The main body 123 further has a threaded portion 141 which is formed in the inside facing surface 140, and which is located at the second end 125. Additionally, in this form of the invention, a flange member 142 is provided, and which has an engagement portion 143 which threadably engages the threaded portion 141 of the inside facing surface 140. In this form of the invention, a coil spring 145 is provided and which is received in the annular shaped passageway 133. Additionally, as seen in FIG. 9, a fluid discharge aperture 146 is formed in the second end 125 of the main body 123. The fluid discharge aperture 146 operates in a manner similar to that described for the fluid discharge aperture 91 as seen in the first form of the invention.

In the second form of the invention 120, the second portion 122 has a main body 150 which has opposite first and second ends 151 and 152, respectively. Still further, the second portion has an outside facing surface 153, and an opposite inside facing surface 154 which defines the second fluid passageway 155. The second fluid passageway is substantially coaxially aligned relative to the first fluid passageway 130 described, above. Again, in this second form of the invention 120, the second portion 122 has a reduced diametral portion 160 which is operable to be telescopingly received within the coil spring 145 as shown in the drawing. Still further, the main body of the second portion 150 includes a circumscribing, movement limiting flange 161 which operates similarly to that earlier disclosed with the first form of the invention. Similarly, in this form of the invention, a hose barb 163 is provided, and which operates in the same fashion. As seen in the drawings, the second portion 150 is operable to move along a path of travel 164 between a first position 165 which substantially occludes the fluid discharge aperture 146, and a second position 166, and which allows fluid 18 to pass therethrough. The structure of the main body of the second portion 150 is similar to that described with the first form of the invention and therefore further recitation of that structure is not warranted under these circumstances.

Operation

The operation of the described embodiment of the present invention 10 is believed to be readily apparent and is briefly summarized at this point. As earlier discussed, a first broad aspect of the present invention relates to a drain plug 10 for selectively draining a source of fluid 18, and which includes a first portion 20 which releasably mates with a reservoir 16 which encloses a source of fluid 18 to be drained, and which further defines the first fluid passageway 30. The drain plug 10 further includes a second portion 60 which telescopes at least partially within the first fluid passageway 30, and which is slideably moveable within the first fluid passageway 30. The second portion 60 defines a second fluid passageway 70 which is coaxially aligned with the first fluid passageway 30. Still further, the drain plug 30 includes a third portion 80 which is telescopingly received within the second fluid passageway 70, and which further is affixed to the first portion 20. The third portion 80 defines a third fluid passageway 90 which is coaxially aligned with the first and second fluid passageways 30 and 70, respectively. The second portion 60 is slideably moveable from a first position 101 which inhibits the source of fluid 18 from passing out through the coaxially aligned first, second and third fluid passageways 30, 70, and 90 respectively, and a second position 102, where the second portion 60 permits the source of fluid 18 to pass through the coaxially aligned first, second and third fluid passageways 30, 70 and 90, respectively. In the present invention the drain plug 10 includes a coil spring 50 which is received within the first fluid passageway 30, and which is further positioned between the first end 62 of the second portion 60 of the drain plug, and is located in resting receipt on the spring seat 34. The coil spring 50 biasingly urges the second portion 60 of the drain plug 10 in the direction of the first position 101. The first end 62 of the second portion 60 is telescopingly received at least in part within the coil spring 50 as seen in FIG. 7.

More specifically, the present invention includes a drain plug 10 for selectively draining a source of fluid 18 which includes a first portion 20 of the drain plug having a main body 21, with a first end 22, and which releasably mates with a reservoir 16 which encloses a source of fluid 18 to be drained, and an opposite second end 23. A first fluid passageway 30 extends from the first to the second ends 22 and 23, respectively. A second portion 60 of the drain plug 10 has a main body 61 with a first end 62 which telescopes at least partially within the first fluid passageway 30, and which is defined by the first portion 20, and which further is slideably moveable within the first fluid passageway 30. The second portion 60, further has a second end 63 which extends coaxially, outwardly relative to the second end 23, of the first portion 20 of the drain plug 10. A second fluid passageway 70 extends between the first and second ends 62 and 63 of the second portion 60, and which is further coaxially aligned with the first fluid passageway 30. The drain plug 10 further includes a third portion 80 which has a main body 81, and which further has a first end 82, and which is telescopingly received, at least in part, within the coaxially aligned first and second fluid passageways, 30 and 70, respectively, as defined by the first and second drain plug portions 20 and 60, respectively. The first end 82, of the third portion 80, is releasably affixed to the first portion 20 of the drain plug. The main body 81 of the third portion 80 has an opposite second end 83. A third fluid passageway 90 extends between the first end 82, and in the direction of the second end 83 of the main body 81 of the third portion 80. The second portion 60 of the drain plug 10 is slideably moveable from a first position 101. In the first position 101, the second portion 60 is located in covering, occluding relationship relative to the fluid discharge orifice 91. In this position, the second portion 60 inhibits the source of the fluid 18 from passing out through the coaxially aligned first, second and third fluid passageways 30, 70, and 90, respectively. Still further, the second portion 60, when located in a second position 102, is moved to a non-occluding position relative to the fluid discharge orifice 91, and which further permits the source of the fluid 18 to pass through the coaxially aligned first, second and third fluid passageways 30, 70, and 90, respectively, and be released through the fluid discharge orifice 91. In the present invention, the drain plug 10 includes a coil spring 50 which is received within the first fluid passageway 30, and which is positioned between the first end 63, of the second portion 60, of the drain plug 10, and the main body 21 of the first portion 20. The coil spring 50 biasingly urges the second portion 60 of the drain plug in the direction of the first position 101.

A second form of the invention 120 is illustrated in FIG. 9 and represents an alternative design of the present invention. More specifically, the second form of the invention 120 represents a drain plug for selectively draining a source of fluid 18 which includes a first portion 121 having a main body 123, and which releasably mates with a reservoir 16 enclosing the source of fluid 18 to be drained. The main body 123 defines a first fluid passageway 130, and which further defines, an annular shaped passageway 133. Still further, and in the second form of the invention 120, the drain plug includes a second portion 122 which telescopes, at least partially within, the annular shaped passageway 133 which is defined by the main body 123 of the first portion 121. The second portion defines a second fluid passageway 155 which is coaxially aligned with the first fluid passageway 130. The second portion 122 is slideably moveable from a first position, 165, which inhibits the source of fluid 18 from passing out through the coaxially aligned first and second fluid passageways 130 and 155, respectively; and a second position, 166, where the second portion 122 permits the source of fluid 18 to pass through the coaxially aligned first and second fluid passageways 130 and 155, respectively.

Therefore, it will be seen that the present drain plug arrangement provides a convenient and novel means by which a source of fluid, such as oil, and the like 18, may be drained from an object of interest such as a power tool 11 or the like. The present invention is easy to utilize, convenient, and provides a mean by which fluids 18 such as lubricants, transmission fluids, and other liquids may be easily removed and disposed of in a convenient, safe, and environmentally friendly matter.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modification within the proper scope of the appended claims appropriately interpreted in accordance with the Doctrine of Equivalence.

I claim:

1. A drain plug for selectively draining a source of fluid, comprising:

a first portion having a main body which releasably mates with a reservoir enclosing a source of fluid to be drained, and which defines a first fluid passageway, and an annular shaped passageway, and wherein the main body of the first portion has a first end which screw threadably mates with the reservoir, and an opposite, second end, and wherein the first fluid passageway extends between the first and second ends thereof, and wherein the first fluid passageway which is defined by the first portion of the drain plug has a first section, having a predetermined diametral dimension, and a second section having a predetermined diametral dimension greater than the first section, and wherein the first section of the first fluid passageway has a screw threaded region formed therein, and wherein a spring seat is defined between the first and second sections of the first fluid passageway, and wherein the main body of the first portion of the drain plug has a guidance pin passageway formed in the second end of the main body thereof, and wherein the guidance pin passageway has a first, and an opposite second end;

a second portion which telescopes at least partially within the annular shaped passageway defined by the main body of the first portion, and which further defines a second fluid passageway which is coaxially aligned with the first fluid passageway; and wherein the second portion is slideably moveable from a first position which inhibits the source of fluid from passing out through the coaxially aligned first, and second fluid passageways, and a second position, where the second portion permits the source of fluid to pass through the coaxially aligned first, and second fluid passageways; and a third portion which is telescopingly received within the second fluid passageway, and which is releasably affixed to the first portion, and wherein the third portion defines, at least in part the annular shaped passageway of the first portion, and wherein the third portion defines a third fluid passageway which is coaxially aligned with the first and second fluid passageways, and wherein the second portion is slideably moveable from the first position which inhibits the source of fluid from passing out through the coaxially aligned first, second and third passageways, and the second position, where the second portion permits the source of fluid to pass through the coaxially aligned first, second, and third fluid passageways, and wherein a coil spring is received within the first fluid passageway, and which is further positioned between the first end of the second portion of the drain plug, and is located in resting receipt on the spring seat, and wherein the coil spring biasingly urges the second portion of the drain plug in the direction of the first position, and wherein the first end of the second portion is telescopingly received, at least in part, within the coil spring.

2. The drain plug as claimed in claim 1, and wherein the annular shaped passageway extends between the second end of the main body of the first portion, and in the direction of the first end thereof.

3. The drain plug as claimed in claim 2, and wherein the second end of the main body of the first portion has an outside facing surface which has a sealing ring seat formed therein, and wherein a resilient seal is received in the sealing ring seat, and wherein the drain plug further comprises a flange member which matingly, releasably cooperates with the second end of the main body, and which occludes the first fluid passageway at the second end of the main body of the first portion.

4. A drain plug as claimed in claim 3, and wherein a pair of sealing members are mounted on the third portion of the drain plug, and which individually, sealingly engage the second portion of the drain plug, and wherein the respective sealing members inhibit the movement of the fluid to be drained from moving between the second and third portions of the drain plug, and wherein the pair of sealing members comprise a first sealing member which is located between the first and second ends of the third portion, and a second sealing member which is located at the second end of the third portion of the drain plug.

5. A drain plug as claimed in claim 4, and wherein the first end of the third portion threadably cooperates with the screw threaded region which is defined by the first fluid passageway, and wherein the third portion includes a fluid discharge orifice which is located in spaced relation relative to the second end of the third portion, and wherein the third portion has a flange member located at the second end thereof, and wherein the second sealing member is positioned in juxtaposed, rested relation thereagainst the flange member, and wherein the first sealing member is located between the opposite first and second ends of third portion, and is received within a circumscribing seal seat formed in the third portion, and wherein the second end of the second portion, when located in the first position, sealably engages the second sealing member which is mounted on the second end of the third portion of the drain plug, and wherein the first sealing member sealingly engages the second portion as the second portion moves between the first and second positions.

6. A drain plug as claimed in claim 5, and wherein, the second portion of the drain plug further has a hose barb mounted on, and circumscribing the second end thereof, and wherein a guidance pin is mounted on the second portion of the drain plug, and which further extends radially, outwardly relative thereto, and wherein the guidance pin is located between the first and second ends of the second portion of the drain plug, and wherein the second portion of the drain plug further includes a movement limiting, and circumscribing flange member which extends substantially radially outwardly relative to the second portion, and which is further located between the guidance pin, and the second end of second portion, and wherein the guidance pin is dimensioned for receipt and movement along the guidance pin passageway, and wherein placement of the guidance pin along the guidance pin passageway, and at the first end thereof, is effective in placing the second portion of the drain plug in the first position, and which inhibits the source of the fluid from passing out through the first, second and third coaxially aligned fluid passageways, and wherein placement of the guidance pin at the second end of the guidance pin passageway is effective in placing the second portion of the drain plug in the second position, and where the second portion of the drain plug is located in a non-occluding position relative to the fluid discharge orifice, and which further permits the source of the fluid to pass through the coaxially aligned first, second, and third fluid passageways and be released through the fluid discharge orifice.

7. A drain plug as claimed in claim 6, and further comprising a predetermined length of resilient conduit which is selectively, matingly coupled to the hose barb, and which further facilitates the channeling of the fluid released from the reservoir to a remote location.

8. A drain plug for selectively draining a source of fluid, comprising:

a first portion of the drain plug having a main body with a first end which releasably mates with a reservoir enclosing a source of fluid to be drained, and an opposite second end, and wherein a first fluid passageway extends from the first to the second end, and wherein the first fluid passageway which is defined by the first portion of the drain plug has a first section having a predetermined diametral dimension, and a second section having a predetermined diametral dimension greater than the first section, and wherein the first section of the first fluid passageway has a screw threaded region formed therein, and wherein a spring seat is defined between the first and second sections of the first fluid passageway, and wherein the main body of the first portion of the drain plug has a guidance pin passageway formed in the second end of the main body thereof, and wherein the guidance pin passageway has a first, and an opposite, second end, and wherein the first end of the drain plug releasably, threadably mates with the reservoir enclosing the source of fluid to be drained;

a second portion of the drain plug having a main body with a first end which telescopes, at least partially, within the first fluid passageway which is defined by the first portion, and which is slideably movable within the first fluid passageway, and wherein the second portion further has a second end which extends coaxially, outwardly, relative to the second end of the first portion of the drain plug, and wherein a second fluid passageway extends between the first and second ends of the second portion, and which is further coaxially aligned with the first fluid passageway;

a coil spring received within the first fluid passageway, and which is positioned between the first end of the second portion of the drain plug, and the main body of the first portion, and wherein the coil spring biasingly urges the second portion of the drain plug in the direction of the first position, and wherein the coil spring rests on the spring seat, and wherein the first end of the second portion of the drain plug is telescopingly received, at least in part, within the coil spring;

a third portion of the drain plug which has a main body that has a first end which is telescopingly received, at least in part, within the coaxially aligned first and second fluid passageways as defined by the first and second drain plug portions, and wherein the first end of the third portion is releasably affixed to the first portion of the drain plug, and wherein the main body of the third portion has an opposite, second end, and wherein a third fluid passageway extends between the first and second ends of the third portion, and wherein a fluid discharge orifice is formed at a location adjacent to the second end of the main body of the third portion, and wherein the second portion of the drain plug is slideably moveable from a first position, where the second portion is located in covering, occluding relation relative to the fluid discharge orifice, and which inhibits the source of the fluid from passing out through the coaxially aligned first, second, and third fluid passageways, and a second position where the second portion is moved to a non-occluding position relative to the fluid discharge orifice, and which further permits the source of the fluid to pass through the coaxially aligned first, second, and third fluid passageways, and be released through the fluid discharge orifice, and wherein the first end of the third portion of the drain plug threadably engages the threaded region of the first section of the first fluid passageway; and a pair of sealing members mounted on the third portion of the drain plug, and which individually sealingly engage the second portion of the drain plug, and wherein the respective sealing members inhibit the movement of the fluid to be drained from moving between the second and third portions of the drain plug, and wherein the pair of sealing members comprise a first sealing member which is located between the first and second ends of the third portion, and a second sealing member which is located at the second end of the third portion of the drain plug.

9. A drain plug as claimed in claim 8, and wherein the guidance pin passageway formed in the first portion of the drain plug is defined by a first, and a second leg, and wherein the first portion of the drain plug has a longitudinal axis, and wherein the first leg of the guidance pin passageway is directed longitudinally relative to the main body of the first portion, and wherein the second leg of the guidance pin passageway is oriented in a substantially normal orientation relative to the longitudinal axis of the first portion of the drain plug, and wherein a guidance pin seat is formed in the second end of the guidance pin passageway.

10. A drain plug as claimed in claim 9, and wherein the second portion of the drain plug further has a hose barb mounted on and circumscribing the second end thereof, and wherein a guidance pin is mounted on the main body of the second portion of the drain plug, and which further extends radially, outwardly, relative thereto, and wherein the guidance pin is located between the first and second ends of the second portion of the drain plug, and wherein the second portion of the drain plug further includes a movement limiting, and circumscribing flange member which extends substantially radially outwardly relative to the main body of the second portion, and which is further located between the guidance pin, and the second end of the main body, and wherein the guidance pin is dimensioned for receipt and movement along the guidance pin passageway, and wherein the placement of the guidance pin along the guidance pin passageway, and at the first end thereof, is effective in placing the second portion of the drain plug in the first position and which inhibits the source of fluid from passing out through the first, second and third coaxially aligned fluid passageways, and wherein the placement of the guidance pin at the second end of the guidance pin passageway, and in the guidance pin seat, is effective in placing the second portion of the drain plug in the second position, and where the second portion of the drain plug is located in a non-occluding position relative to the fluid discharge orifice, and which further permits the source of the fluid to pass through the coaxially aligned first, second, and third fluid passageways and be released through the fluid discharge orifice.

11. A drain plug as claimed in claim 10, and wherein the second end of the third portion has a flange member, and the second sealing member is positioned in juxtaposed, rested relation thereagainst the flange member, and wherein the main body of the first portion has an exterior facing tool engagement region which allows a tool to engage the main body of the first portion of the drain plug, and impart rotational movement to the first portion so as to allow the first portion to threadably engage or disengage from the reservoir.

* * * * *